United States Patent [19]

Peyser et al.

[11] Patent Number: 4,475,252

[45] Date of Patent: Oct. 9, 1984

[54] GARMENT HAVING ADJUSTABLE SLEEVE MEANS

[76] Inventors: Eliot Peyser, 447 E. Beech St., Long Beach, N.Y. 11561; Miriam Peyser, 500 E. 85th St. Apt. 10G, New York, N.Y. 10028

[21] Appl. No.: 491,500

[22] Filed: May 4, 1983

[51] Int. Cl.[3] ..... A41B 1/08

[52] U.S. Cl. ..... 2/125

[58] Field of Search ..... 2/125, 269, 270, 126

[56] References Cited

U.S. PATENT DOCUMENTS

| | | | |
|---|---|---|---|
| 237,096 | 2/1881 | Delmonte | 2/269 |
| 811,662 | 2/1906 | Puryear | 2/269 |
| 1,174,775 | 3/1916 | Thorman | 2/270 |
| 1,593,027 | 7/1926 | Montague | 2/269 |
| 4,149,275 | 4/1979 | Sanchez | 2/269 |
| 4,200,938 | 5/1980 | Le Tourneau | 2/269 |

*Primary Examiner*—Doris L. Troutman

*Attorney, Agent, or Firm*—Panitch, Schwarze, Jacobs & Nadel

[57] ABSTRACT

A jacket is provided having adjustable sleeves which may be worn with the sleeves below the elbow, such as down to the wrist or with the sleeves rolled up to the shoulder to suit the wearer. A loop is provided on the interior of each sleeve which cooperates with an adjustable epaulet on each shoulder of the jacket to retain the sleeve when rolled up. The epaulets are threaded through the loops and are fastened about the loops by snap closures on the epaulets.

4 Claims, 4 Drawing Figures

FIG. 1
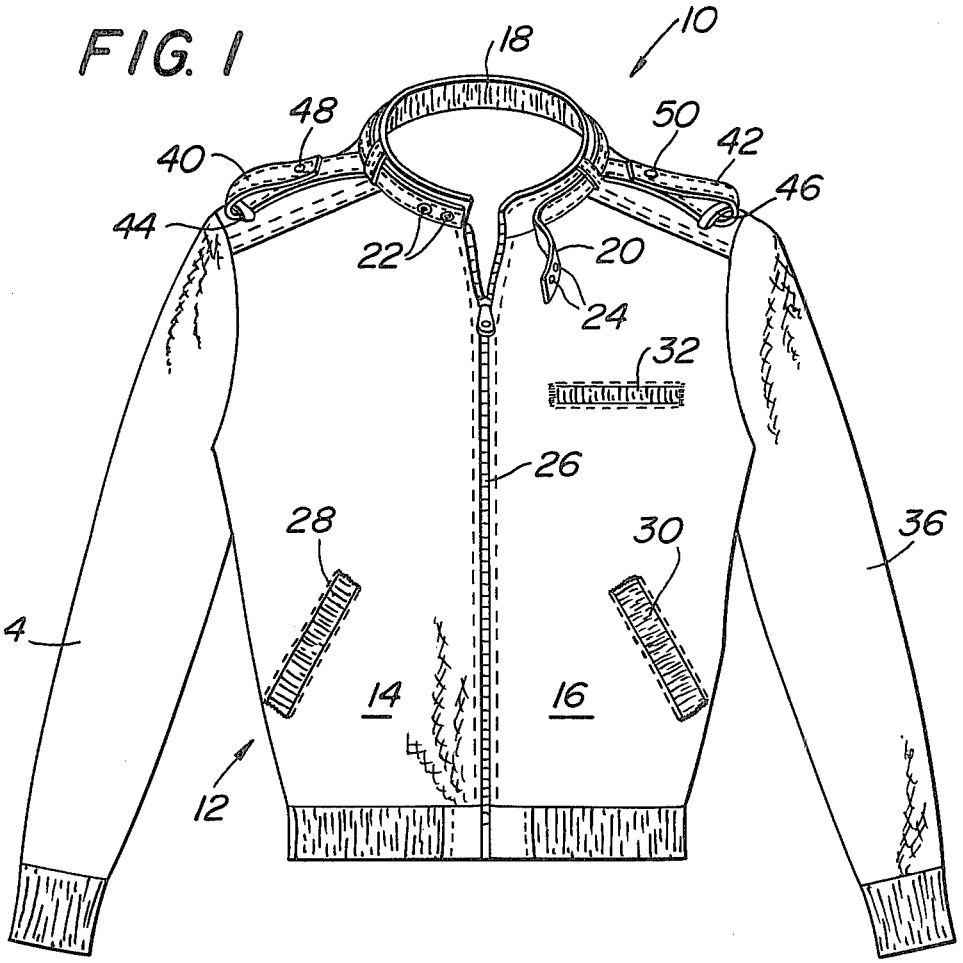
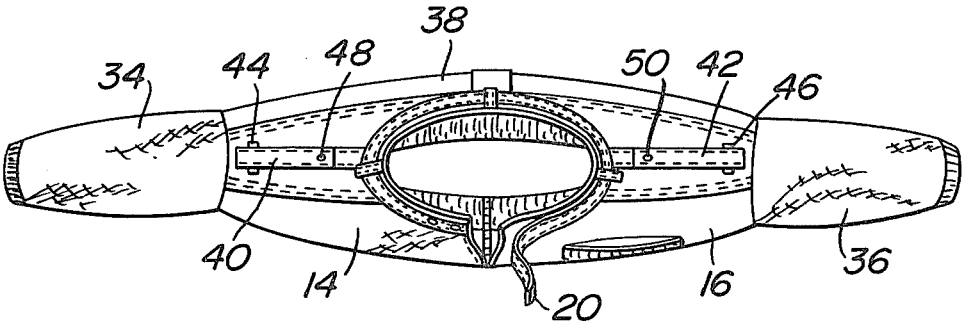
FIG. 2

10
14
16
18
20
22
24
26
32
34
36
40
42
44
46
48'
48''
50'
50''
50'''
52
54
4

GARMENT HAVING ADJUSTABLE SLEEVE MEANS

BACKGROUND OF THE INVENTION

This invention relates to a garment, in particular an outer garment such as a jacket, which may be readily converted from a long-sleeve garment to a short-sleeve garment as desired by the wearer.

It frequently happens, especially in warm weather, that the wearer of a jacket desires to roll up the sleeves to avoid becoming too warm, or to allow his arms more freedom or to protect the sleeves from soiling or damage. Typical jackets, however, lack a means for retaining the sleeves in the rolled up position. Consequently, the sleeves have a tendency to unroll or slip down, and require constant readjustment by the wearer. This can be quite annoying and undesirable, especially if the wearer's hands are full or have become soiled.

SUMMARY OF THE INVENTION

The present invention is a garment for the torso and arms which comprises a body portion and sleeves attached to the body portion at the shoulders thereof. The sleeves extend below the elbow of the wearer and may be rolled up to the shoulders of the garment. Fastening means are attached to each shoulder of the garment and means are provided on the inner surface of each sleeve to cooperatively engage the fastening means on the respective shoulder for retaining the sleeves in position when the sleeves are rolled up. In particular, the present invention includes a jacket having adjustable sleeves which comprises a body portion and sleeves attached to the body portion of the jacket at the shoulders thereof and which are adjustable from a first position in which the sleeves extend to the wrist of the wearer to a second position in which the sleeves are rolled up to the shoulders of the garment. A loop is attached to the inner surface of each sleeve which is exposed when the sleeve is in the second, or rolled-up, position. Epaulets in the form of a strip are fixedly attached at one end to each shoulder of the jacket, the other end of each epaulet being insertable through the loop attached to the respective sleeve and then doubled back and removably attached to the epaulet by fastening means, such as a snap closure so as to form a loop which interlocks to the loop attached to the respective sleeve to retain the sleeves in the second position.

An advantage of the present invention is that the garment may be converted easily from a long sleeve garment to a short sleeve garment to suit the wearer.

A further advantage of the invention is that the sleeves are readily and conveniently retained in a neat, rolled up position.

For the purpose of illustrating the invention, there is shown in the drawings a form which is presently preferred; it being understood, however, that this invention is not limited to the precise arrangements and instrumentalities shown.

BRIEF DESCRIPTION OF THE DRAWINGS

FIG. 1 is a front perspective view of a jacket in accordance with the present invention, showing the sleeves fully extended.

FIG. 2 is a plan view of the jacket shown in FIG. 1.

DETAILED DESCRIPTION OF THE PREFERRED EMBODIMENTS

Figures 3, 4:
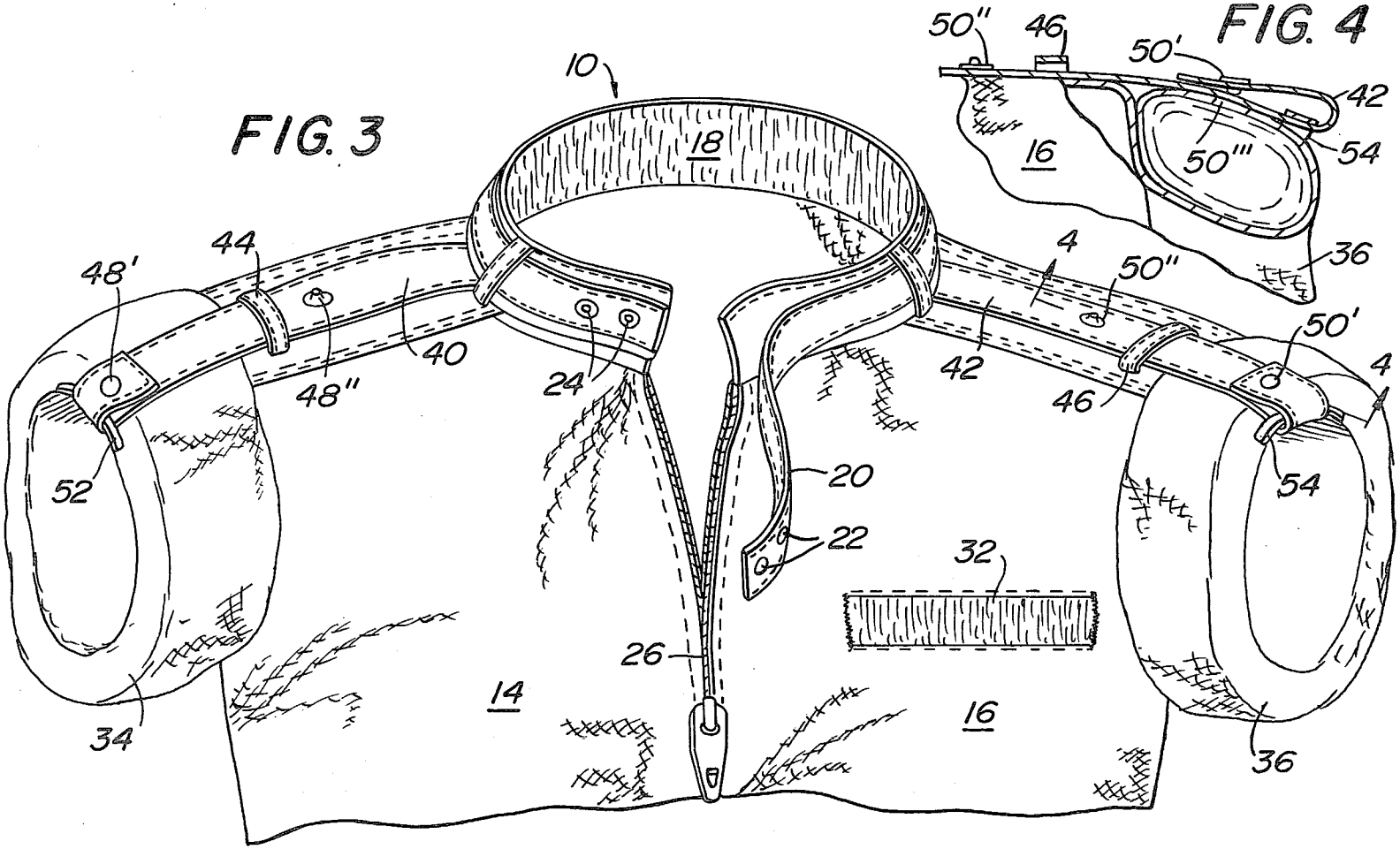
FIG. 3 is an enlarged view of the upper portion of the jacket shown in FIG. 1, illustrating the sleeves in the rolled up position.
FIG. 4 is a sectional view taken along the line 4—4 of FIG. 3, showing the details of the sleeve retaining means.

Referring now to the drawings wherein like numerals indicate like elements, there is shown in FIG. 1 a jacket 10 in accordance with the present invention. Jacket 10 has a body portion 12 consisting of a right side 14 and a left side 16 which may be fastened together by zipper 26 or other suitable means such as buttons or snaps. Jacket 10 also has a collar 18, which may be left open by the wearer or closed by the closing means 20 in the form of a strip having fastening means at each end. The closing means 20 includes male and female snap means 22 and 24 respectively at opposite ends thereof which cooperate in a well-known manner to close the collar.

Jacket 10 further includes right sleeve 34 and left sleeve 36, which are illustrated in FIG. 1 in their fully extended position. In this position, sleeves 34 and 36 extend to the wrists of the wearer. However, the present invention should not be considered to be limited to garments in which the sleeves reach the wearer's wrist when extended. Thus the invention also relates to garments in which the sleeves extend below the wearer's elbow, such as three-quarter length sleeves and the like.

The right and left shoulder portions of the jacket 10 are provided with epaulets 40 and 42 respectively. Epaulets 40 and 42 are in the form of a strip, and one end of each epaulet 40, 42 is secured to the shoulder portion of jacket 10, for example by sewing, and is fastened preferably at or near the location where the collar 18 joins the shoulder portions of jacket 10. The other end of each epaulet 40, 42 is left unfastened and is provided with fastening means, shown in the drawings as female snap means 48′ and 50′, respectively, but which may be any suitable fastening means such as Velcro TM. The right and left shoulder portions of jacket 10 are also provided with loops 44 and 46 respectively to retain epaulets 40, 42 when the jacket is worn with the sleeves down.

When the jacket is worn with sleeves 34 and 36 fully extended, as illustrated in FIGS. 1 and 2, epaulets 40 and 42 are passed under loops 44 and 46, respectively, which are attached to the shoulder portions of jacket 10, and are doubled back over loops 44 and 46 and fastened by mating snaps 48′, 48″ and 50′, 50″ as at 48 and 50, respectively. In this manner, the epaulets 40, 42 present a neat appearance and are securely fastened to prevent unwanted movement.

As illustrated in FIG. 3, jacket 10 may also be worn with the sleeves rolled up to the shoulder. Right and left sleeves 34 and 36 are provided with loops 52 and 54, respectively, which are located on the interior of sleeves 34 and 36. When the wearer desires to wear the jacket with sleeves 34, 36 in the rolled up position, he merely rolls the sleeves up beginning at the cuff until loops 52 and 54 are exposed. He then unfastens epaulets 40 and 42 by opening snap closures 48 and 50. The free ends of epaulets 40 and 42 are then passed through loops 52 and 54, respectively, and the free end of the epaulet is doubled back and fastened to male snap means 48‴ (not shown) and 50‴, as best seen in FIG. 4. Epaulets 40 and 42 form loops or bights which interlock with loops 52 and 54 and thus securely retain sleeves 34 and 36 in the rolled up position. The ends of loops 52 and 54 are attached to the inside of the sleeves in two spaced positions, thus spreading out the retaining force. This allows the sleeves to have a neat, tidy appearance when retained in a rolled up position.

To wear the jacket with the sleeves in the fully extended position, the wearer merely unfastens epaulets 40 and 42 by disengaging snap means 48′, 48‴ and 50′, 50‴, pulls the epaulets through loops 52 and 54 and fastens the free ends of the epaulets by mating female snap means 48′ and 50′ to male snap means 48″ and 50″ respectively. Sleeves 34 and 36 may be then rolled downward to their fully extended position.

Jacket 10 may be provided with pockets 28, 30 and 32, and may be made in any style or length to suit the current fashion.

The present invention may be embodied in other specific forms without departing from the spirit or essential attributes thereof and, accordingly, reference should be made to the appended claims, rather than to the foregoing specification, as indicating the scope of the invention.

We claim:

1. A garment for the torso and arms, comprising:
(a) a body portion,
(b) sleeves attached to the body portion at the shoulders thereof which extend below the elbow of the wearer and which may be rolled up to the shoulders of the garment,
(c) fastening means comprising a strip fixedly attached at one end to each shoulder of the garment the other end of the strip being doubled back and removably attached to the strip so as to form a bight adjacent to the other end, and
(d) a loop on the inner surface of each sleeve which cooperatively engages the bight of the strip on the respective shoulder for retaining the sleeves in position when the sleeves are rolled up.

2. A garment as in claim 1, wherein the loop is attached to the inner surface of each sleeve at two spaced positions.

3. A jacket having adjustable sleeves, comprising
(a) a body portion,
(b) sleeves attached to the body portion of the jacket at the shoulders thereof which are adjustable from a first position in which the sleeves extend to the wrist of the wearer to a second position in which the sleeves are rolled up to the shoulders of the garment,
(c) a loop attached to the inner surface of each sleeve which is exposed when the sleeve is in the second position, and
(d) epaulets in the form of a strip fixedly attached at one end to each shoulder of the jacket, the other end of each epaulet being insertable through the loop attached to the respective sleeve and then doubled back and removably attached to the epaulet by a snap closure so as to form a bight which interlocks with the loop attached to the respective sleeve to retain the sleeves in the second position.

4. A jacket as in claim 3, wherein the loop attached to the inner surface of each sleeve is attached to said surface at two spaced positions.

* * * * *